US007374468B2

(12) United States Patent
Flodin et al.

(10) Patent No.: US 7,374,468 B2
(45) Date of Patent: May 20, 2008

(54) CONSTRUCTION SYSTEM

(75) Inventors: James E. Flodin, Hope, RI (US); Albert W. Seifert, Mystic, CT (US)

(73) Assignee: Greene Plastics Corporation, Hope Valley, RI (US)

( * ) Notice: Subject to any disclaimer, the term of this patent is extended or adjusted under 35 U.S.C. 154(b) by 187 days.

(21) Appl. No.: 11/193,753

(22) Filed: Jul. 29, 2005

(65) Prior Publication Data

US 2007/0026759 A1 Feb. 1, 2007

(51) Int. Cl.
*A63H 33/04* (2006.01)
*A63H 33/00* (2006.01)

(52) U.S. Cl. ..... 446/85; 446/102; 446/107; 446/122; 446/124

(58) Field of Classification Search ..... 446/85, 446/102, 124, 125, 126, 106, 107, 117; 273/153 R, 273/156, 127 R; 52/586.1, 586, 582.1
See application file for complete search history.

(56) References Cited

U.S. PATENT DOCUMENTS

| | | | | |
|---|---|---|---|---|
| 383,442 | A | 5/1888 | Crandall | |
| 853,756 | A | 5/1907 | Bétis | |
| 1,113,371 | A | 10/1914 | Pajeau | |
| 1,851,159 | A | 3/1932 | Dodge | |
| 2,170,771 | A | 8/1939 | Benjamin | 46/29 |
| 2,208,049 | A | 7/1940 | Pajeau | 46/29 |
| 2,662,335 | A | 12/1953 | Caverley | 46/22 |
| 2,709,318 | A * | 5/1955 | Benjamin | 446/103 |
| 2,962,820 | A | 12/1960 | Petersen | 35/18 |
| 3,698,123 | A | 10/1972 | Heldt | 46/29 |
| 3,939,581 | A | 2/1976 | Clarke, Jr. | 35/18 A |
| 4,214,404 | A | 7/1980 | Fischer | 46/26 |
| 4,352,255 | A | 10/1982 | Warehime | 46/16 |
| 5,049,105 | A * | 9/1991 | Glickman | 446/126 |
| 5,120,253 | A | 6/1992 | Gelardi | 446/77 |
| 5,199,919 | A | 4/1993 | Glickman | 446/126 |
| 5,282,767 | A | 2/1994 | Gelardi | 446/126 |
| 6,461,215 | B1 | 10/2002 | Kunz et al. | 446/107 |
| 6,491,563 | B1 * | 12/2002 | Bailey | 446/122 |
| 6,626,727 | B2 * | 9/2003 | Balanchi | 446/85 |
| 6,846,216 | B1 * | 1/2005 | Balanchi | 446/85 |

* cited by examiner

*Primary Examiner*—Kien T Nguyen
(74) *Attorney, Agent, or Firm*—Salter & Michaelson

(57) ABSTRACT

A construction system includes an elongated connection stem with a central member having a uniform first transverse dimension and opposed integral end members, each having a uniform second transverse dimension greater than the first, each end member having a longitudinal slot extending from a tip end to the central member and an attachment member having a central through bore slightly smaller than the second transverse dimension. A cross section of each end member is similarly shaped to the central through bore and slightly larger than the central through bore and a cross section of the central member is similarly shaped to the central through bore but of smaller size than the central through bore. In one instance, the attachment member is fittingly received on either of the opposed end members and, in another instance, the attachment member is slidably received on the central member.

25 Claims, 6 Drawing Sheets

CONSTRUCTION SYSTEM

BACKGROUND OF THE INVENTION

1. Field of the Invention

The present invention relates generally to a toy construction system, and more particularly, to such a system in which components are uniquely formed and can be assembled in a unique manner.

2. Description of the Prior Art

Over the years, many structural toys have been devised and marketed comprising elongated elements connected by joint elements in the form of cubes, spheres, disks, or other appropriate compact components to produce an architectural structure or a replica of a machine or vehicle. The elements and components of such toys have been of great variety, some of simple design and others of fairly complex design. When of complex design, they have been expensive to manufacture. Some of these toys suffer from the fault of rapid wear so that after moderate use, the parts are no longer friction tight and no longer capable of maintaining necessary connections.

In contrast, the present invention provides components of exceedingly simple design, easy and inexpensive to manufacture, and adapted to be used by young children as well as by the older set. Further, while the components are to be fastened and held together by friction, by their,inherent design, wear is minimal and the life of the components and resulting structures and vehicles is maximized.

There are numerous examples of toy construction sets exemplified by patents. A very early example is U.S. Pat. No. 853,756 to Bétis which discloses an educational appliance for kindergarten work in the form of a counting frame in which is arranged a plurality of units in the form of cubes or blocks of any shape, each bearing a plurality of letters, figures, colors or other differentiated faces, susceptible of the various groupings or arrangements required by such work, Toy construction sets using, as a primary component, rods with bifurcated or slotted ends for fitting reception in other components with bored openings are disclosed in U.S. Pat. Nos. 1,113,371 and 2,208,049 to Pajeau, and 3,698,123 to Heldt. U.S. Pat. No. 2,662,335 to Caverley discloses a set of toy or doll building pieces comprising bodies, heads, limbs, feet, and connecting elements which may be interchangeably interconnected. Apparatus for constructing molecular models may be found in U.S. Pat. No. 1,851,159 to Dodge, U.S. Pat. No. 2,962,820 to Petersen, and U.S. Pat. No. 3,939,581 to Clarke, Jr. U.S. Pat. No. 4,214,404 to Fischer discloses a technique of constructing an assembly by connecting hollow structural elements with specially formed connecting elements. A construction toy system which comprises a variety of molded plastic connector elements arranged to be joined with rod-like struts to form complex structural units is presented in U.S. Pat. No. 5,199,919 to Glickman. A variety of other toy structural construction sets and techniques are disclosed in U.S. Pat. No. 4,352,255 to Warehime, and U.S. Pat. Nos. 5,120,253 and 5,282,767 to Gelardi. U.S. Pat. No. 6,461,215 to Kunz et al. discloses toy building sets in the form of box-shaped building blocks provided with coupling studs on one side and complementary coupling holes on an opposite side further provided with a tubular, elongated, flexible, corrugated building element to produce a unique structure.

It was in light of the foregoing that the present invention was conceived and has now been reduced to practice.

SUMMARY OF THE INVENTION

A construction system includes an elongated connection stem with a central member having a uniform first transverse dimension and opposed integral end members, each having a uniform second transverse dimension greater than the first, each end member having a longitudinal slot extending from a tip end towards the central member and an attachment member having a central through bore slightly smaller than the second transverse dimension. A cross section of each end member is similarly shaped to the central through bore and slightly larger than the central through bore and a cross section of the central member is similarly shaped to the central through bore but of smaller size than the central through bore. In one instance, the attachment member is fittingly received on either of the opposed end members and, in another instance, the attachment member is slidably received on the central member.

A primary feature, then, of the present invention, then, is the provision of a toy construction system in which components are uniquely formed and can be assembled in a unique manner.

A further feature of the present invention is the provision of such a toy construction system which includes an elongated connection stem with a central member having a uniform first dimension transverse of the longitudinal axis, opposed end members integral with the central member, each having a uniform second dimension transverse of the longitudinal axis greater than the first transverse dimension, each opposed end member having a longitudinal slot formed into the outer peripheral surface extending from its associated free tip end toward the central member and an attachment member having a central through bore slightly smaller than the second transverse dimension of each of the end members, a cross section of each of the end members perpendicular to the longitudinal axis being of similar shape to that of the central through bore and being slightly larger in size than that of the central through bore and a cross section of the central member perpendicular to the longitudinal axis being of similar shape to that of the central through bore but of smaller size than that of the central through bore such that, in one instance, the attachment member can be fittingly received, via the central through bore, on either of the opposed end members and, in another instance, the attachment member can be slidably received, via the central through bore, on the central member.

Another feature of the present invention is the provision of such a toy construction system in which the connection stem is substantially cylindrical, the central member has a first outer diameter, each of the opposed end members has a second outer diameter, and in which the attachment member has a cylindrical through bore having a diameter slightly smaller than the second outer diameter of each of the end members and slightly larger than the first outer diameter of the central member.

Yet another feature of the present invention is the provision of such a toy construction system in which the length of the attachment member in a direction parallel with the through bore is less than the length of the central member between the opposed end members.

Yet a further feature of the present invention is the provision of such a toy construction system in which the attachment member has a generally spherical outer peripheral surface in one instance and a generally cylindrical outer peripheral surface in another instance.

Still a further feature of the present invention is the provision of such a toy construction system in which the attachment member has at least one partial bore aligned with an axis transverse that of the central through bore and in which a cross section of each of the end members perpendicular to the longitudinal axis is of similar shape to that of the partial bore and slightly larger than the diameter of the partial bore such that the attachment member can be fittingly received via the partial bore on either of the opposed end members.

Still another feature of the present invention is the provision of such a toy construction system in which the central member of the connection stem is curved in some instances and straight in some other instances.

Yet another feature of the present invention is the provision of such a toy construction system in which a plurality of the components can be joined to result in a completed assembly.

Still another feature of the present invention is the provision of such a toy construction system including a plurality of decorative components of various configurations, each decorative component including a body with a central through bore having a transverse dimension slightly smaller than the second outer diameter of each of the end members and slightly larger than the first outer diameter of the central member.

Yet a further feature of the present invention is the provision of such a toy construction system including a plurality of rolling members supporting the assembly for movement along a supporting surface, each rolling member including an axle and a wheel whereby, with a central hub of the wheel slidably received on a central member of the axle and with a plurality of the rolling members so assembled mounted on the assembly by engagement of each free end member with a partial bore of an attachment member and with the outer rims of the wheels rollingly engaged with the supporting surface, the assembly is selectively movable along the supporting surface.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
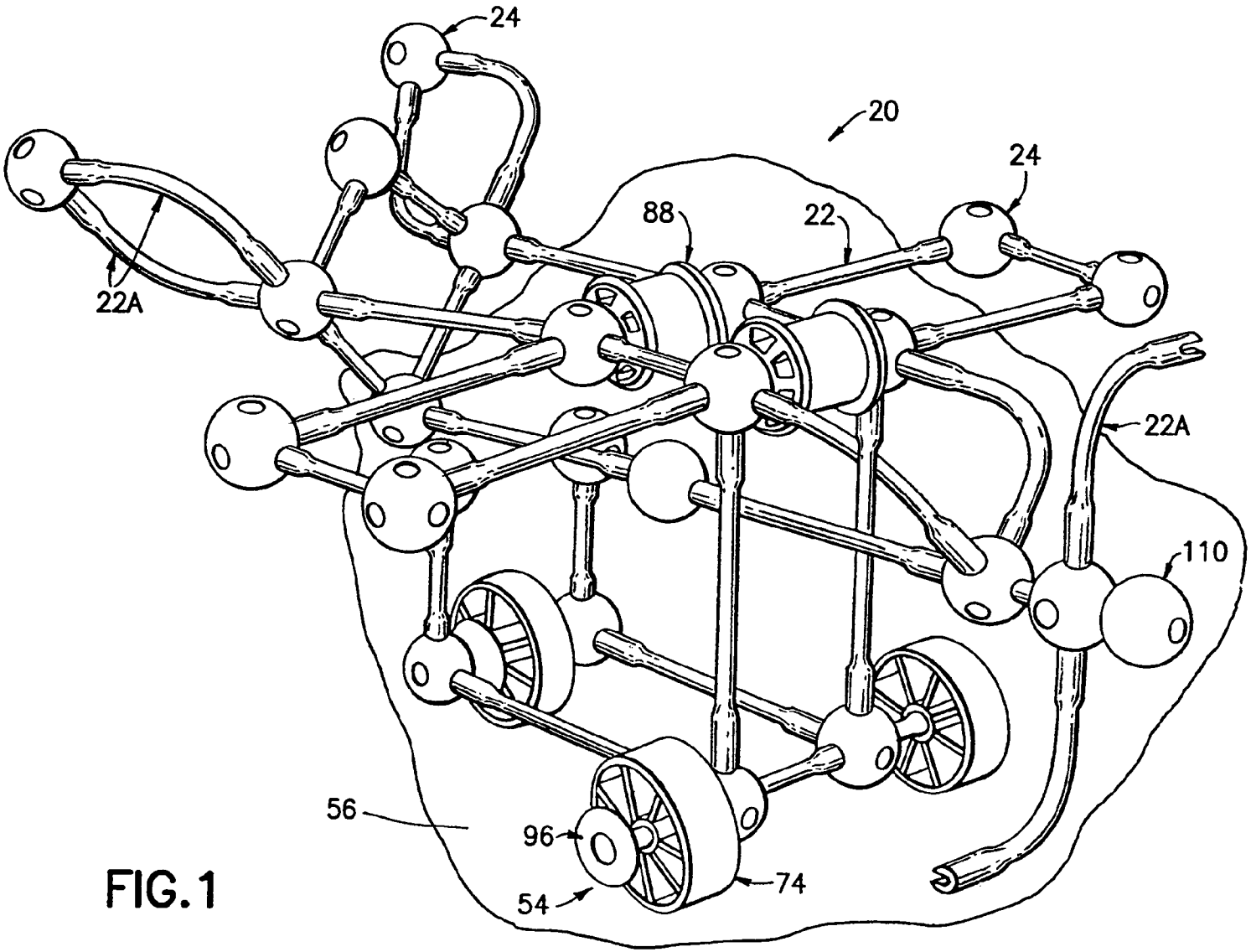
FIG. 1 is a perspective view of an assembly which has resulted from the joining of a plurality of components constituting a construction system embodying the present invention.

Referring to FIG. 1, there are is shown a perspective view of an assembly 20 which has resulted from the joining of a plurality of components constituting a construction system embodying the present invention. Although the present invention will be described with reference to the embodiments shown in the drawings, it should be understood that the present invention can be embodied in many alternate forms or embodiments. In addition, any suitable size, shape or type of elements or materials could be used.

Figure 2:
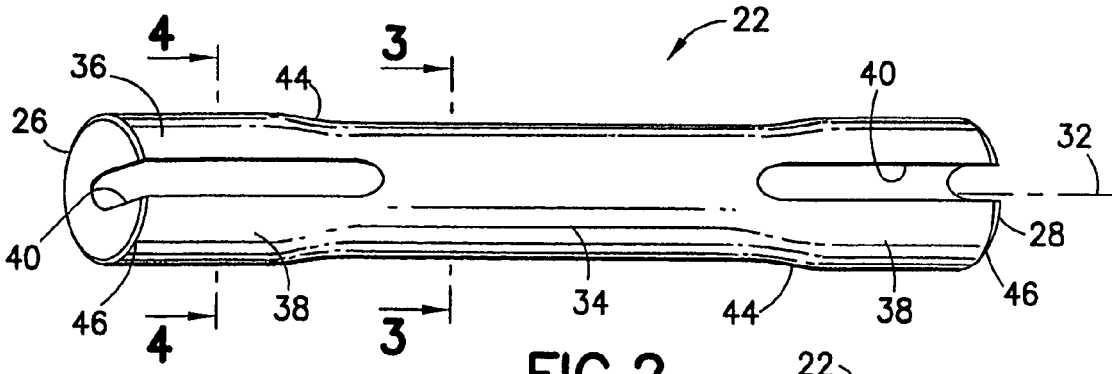
FIG. 2 is a perspective view of a connection stem, a primary component of the invention.

The assembly 20 utilizes a construction system which incorporates, in its most basic form, a plurality of elongated connection stems 22 and a plurality of attachment members 24. A preferable material for manufacture of all of the components of the invention, though not to be limiting of the invention, is high density polyethylene. Turning now to FIG. 2, each connection stem 22 extends between opposed free tip ends 26, 28, has an outer peripheral surface 30, a longitudinal axis 32, and includes a central member 34 having a uniform first dimension $D_1$ (FIG. 3) transverse of the longitudinal axis. Opposed end members 36, 38 are integral with the central member 34 and each has a uniform second dimension $D_2$ (FIG. 4) transverse of the longitudinal axis 32. The second transverse dimension $D_2$ is greater in magnitude than the first transverse dimension $D_1$. Also, each opposed end member 36, 38 has a longitudinal slot 40 formed into the outer peripheral surface 30 extending from its associated free tip end 26 or 28 toward the central member 34. In the preferred instance that the central member 34 and end members 36, 38 are cylindrical, the transverse dimensions $D_1$ and $D_2$ are intended to be diameters. However, it will be understood that the cross sectional shapes of the central member 34 and of the end members 36, 38 may be of a host of other configurations. Also, in this disclosure, the term cylindrical will be taken to include ellipsoid configurations and the term diameter will be taken to mean all appropriate transverse dimensions of such ellipsoid configurations or of other configurations.

Figure 3:
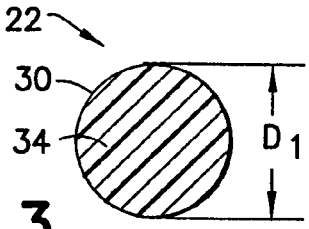
FIG. 3 is a cross section view taken generally along line 3-3 in FIG. 2.
Figure 4:
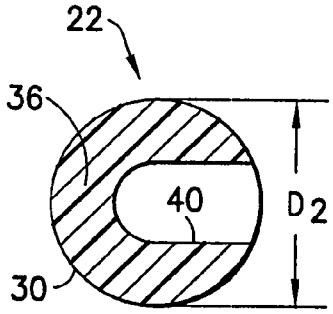
FIG. 4 is a cross section view taken generally along line 4-4 in FIG. 2.
Figure 5:
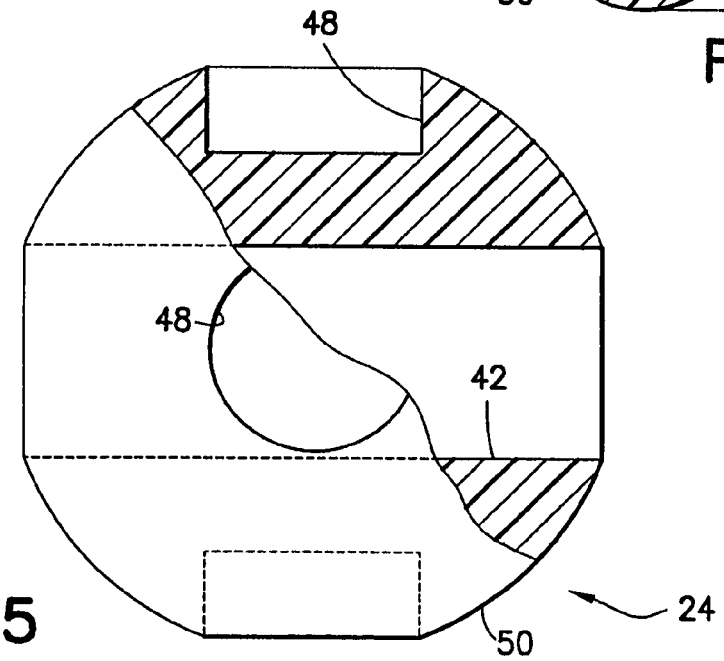
FIG. 5 is a side elevation view, partially cut away and in section, of an attachment member, another primary component of the invention.

Viewing now FIG. 5, each attachment member 24 has a central through bore 42 which is slightly smaller than the second transverse dimension $D_2$ of each of the end members 36, 38. As seen in FIGS. 3 and 4, a cross section of each of the end members 36, 38 perpendicular to the longitudinal axis 32 is of similar shape to that of the central through bore 42 and slightly larger in size than the central through bore.

Figure 6:
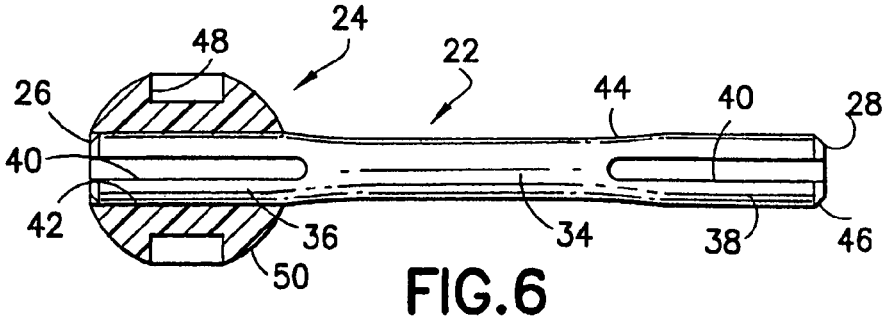
FIG. 6 is a side elevation view, partially cut away and in section, of an assembly of a connection stem with an attachment member.

Somewhat in contrast, while a cross section of the central member 34 perpendicular to the longitudinal axis 32 is of similar shape to that of the central through bore 42 of the attachment member 24, it is of smaller size than the central through bore. With this construction, in one instance as seen in FIG. 6, the attachment member 24 can be fittingly received, via the central through bore 42, on either of the opposed end members 36, 38 and, in another instance as seen in FIG. 7, the attachment member can be slidably received, via the central through bore 42, on the central member 34.

It should also be explained that the outer peripheral surface 30 of each connection stem 22 has a smoothly contoured transition zone 44 between each of the end members 36, 38 and the central member 34 to enable ease of movement of the attachment member from alignment with the central member to its fitting positioning on an end member 36, 38. It is also proper to note that the slot 40 in the end members 36 and 38 provides a measure of band resilience which, together with chamfered end rims 46, enables ease of insertion of the end members, 36, 38 into the through bore 42 of the attachment member 24.

In addition to the central through bore 42, each attachment member has at least one partial bore 48 and, preferably, a plurality of partial bores, each aligned with an axis transverse that of the central through bore. A cross section of each of the end members 36, 38 (see FIG. 4) perpendicular to the longitudinal axis 32 is of similar shape to that of the partial bore 48 and slightly larger than the diameter of the partial bore. The partial bore 48 is so named because it extends only partially into an outer peripheral surface 50 (FIG. 5) of the attachment member 24. With this construction, the attachment member 24 can be fittingly received via the partial bore 48 on either of the opposed end members 36, 38.

Figure 7:
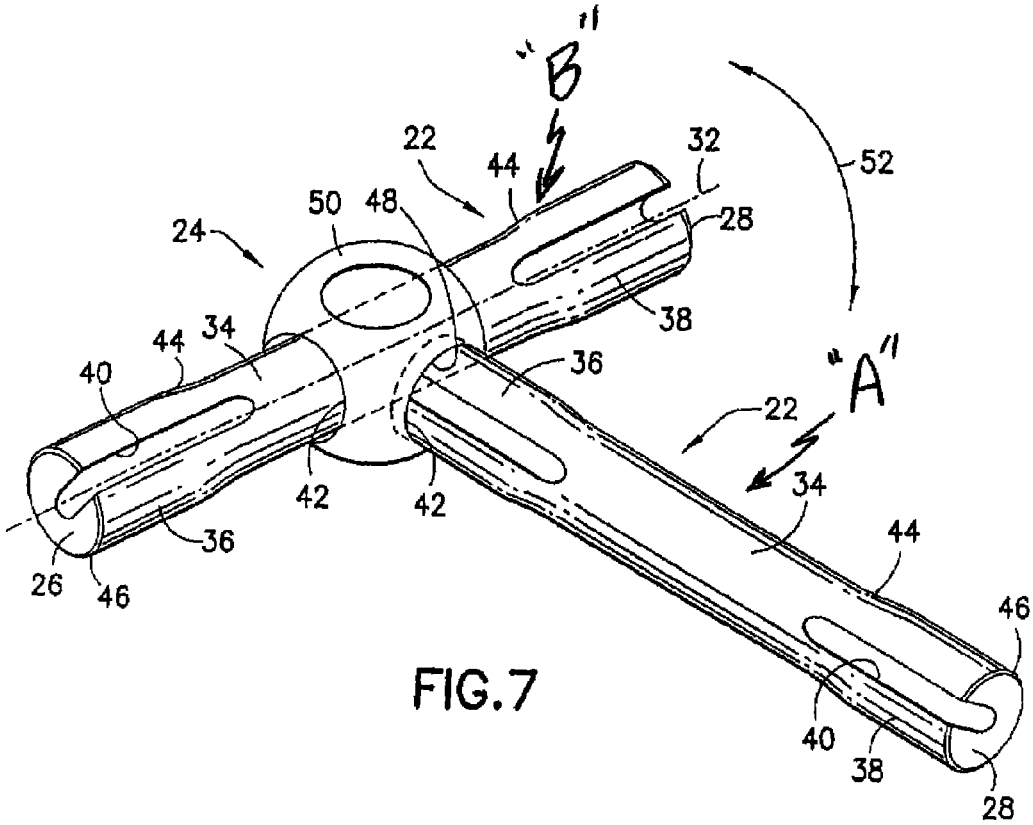
FIG. 7 is a perspective view of an assembly of two connection stems with an attachment member.

As seen in FIG. 7, the length of the attachment member 24 in a direction parallel with the through bore 42 is less than the length of the central member 34 between the opposed end members 36, 38. This construction enables the connection stem 22 whose end member 36 is shown fittingly received in the partial bore 48 of the attachment member 24 to swing to and fro with the attachment member in the directions of double arrowhead 52 about the longitudinal axis 32.

Figure 8:
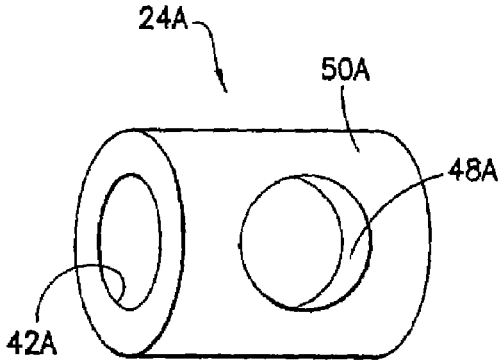
FIG. 8 is a perspective view of another embodiment of an attachment member.

As seen in FIGS. 5, 6, and 7, the attachment member 24 has a generally spherical outer peripheral surface.50. Alternatively, a modified attachment member 24A is illustrated in FIG. 8 having a generally cylindrical outer peripheral surface 50A as well as a through bore 42A and one or more partial bores 48A. Other configurations not illustrated can also be imagined without altering the basic concept of the invention.

Figure 9:
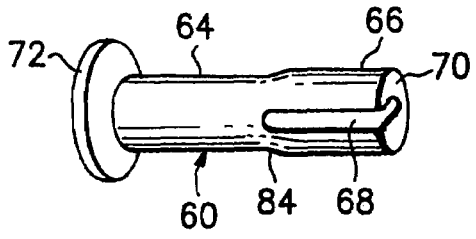
FIG. 9 is a perspective view of an axle for a rolling member of the invention.
Figure 10:
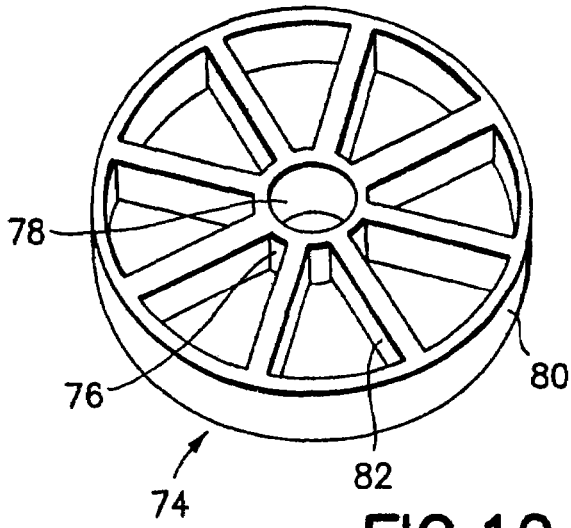
FIG. 10 is a perspective view of a wheel for a rolling member of the invention.

As seen in FIG. 1, a plurality of rolling members 54 support the assembly 20 for movement along a supporting surface 56. Each rolling member 54 includes an axle 58 (FIG. 9) having an outer peripheral surface 60 and a longitudinal axis 62. More specifically, the rolling member 54 includes a cylindrical central member 64 having a uniform first outer diameter, a free end member 66 integral with and axially aligned with the central member having a uniform second outer diameter greater than the first outer diameter and a longitudinal slot 68 formed into the outer peripheral surface 60 extending from its associated free tip end 70 toward the central member. A stop member 72 is integral with the central member 64 and is spaced from the free end member and has a transverse dimension substantially greater than the central member and the free end member 66. Now viewing especially FIG. 10, the rolling member 54 also includes a wheel 74 including a central hub 76 having a journal bore 78 with an inner diameter slightly larger than the first outer diameter of the central member 64 of the axle 58. Further defining the wheel 74 is a circular outer rim 80 and spoke members 82 joining the outer rim to the central hub.

With the central hub 76 of the wheel 74 slidably received on the central member 64 of the axle 58 and with a plurality of the rolling members 54 so assembled mounted on the assembly 20 by engagement of each free end member 66 with a partial bore 48 of an attachment member 24 and with the outer rims 80 of the wheels 74 rollingly engaged with the supporting surface 56, the assembly is selectively rollingly movable along the supporting surface. Also, it will be appreciated that there is a smoothly contoured transition zone 84 between the end member 66 and the central member 64 similar to the transition zones 44 on the connection stem 22 to enable ease of movement of the hub 76 of the wheel 74 from alignment with the central member 64 to its eventual removal from the free end member 66. Chamfered end rims 86, generally similar to the end rims 46 of the connection stem 22 enable ease of insertion of the end members 66 into the journal bore 78 of the wheel 74. Although spoke members 82 are illustrated joining the central hub 76 to the outer rim 80, numerous other constructions are possible, including a disk member, joining those two components of the wheel.

Figure 11:
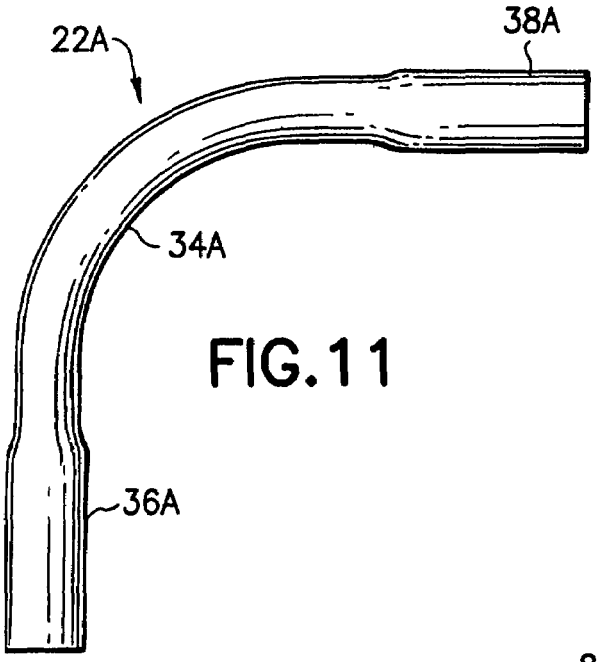
FIG. 11 is a side elevation view of another embodiment of a connection stem.

A modified construction stem 22A is illustrated in FIG. 11 having a curved central member 34A and, indeed, for purposes of the invention, modified construction stems may also be of a variety of lengths.

Figure 12A:
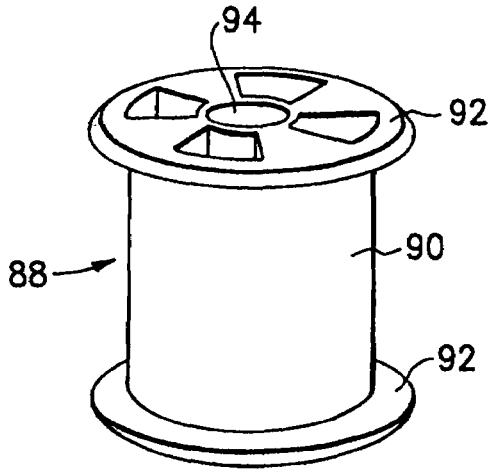
FIGS. 12A through 12G are perspective views of decorative components of various configurations for building an assembly embodying the invention.

A plurality of decorative components of various configurations are also provided for the assembly 20. In FIG. 12A, a spool 88 has a cylindrical body 90 with disk-shaped flanged ends 92 and a central through bore 94 having a transverse dimension slightly smaller than the second outer diameter of each of the end members 36, 38 of the connection stems 22 and slightly larger than the first outer diameter of the central member 34 of the connection stems.

Figure 12B:
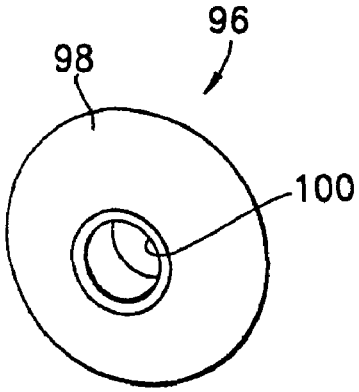

In FIG. 12B, a knob 96 has a curved outer peripheral surface 98 with a central through bore 100 having a transverse dimension slightly smaller than the second outer diameter of each of the end members 36, 38 of the connection stems 22 and slightly larger than the first outer diameter of the central member 34 of the connection stems.

Figure 12C:
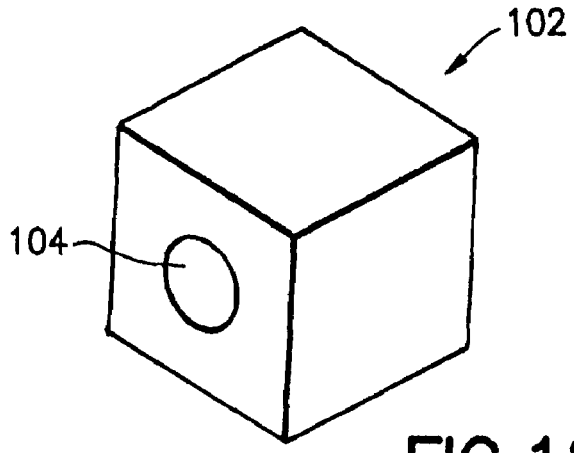

In FIG. 12C, a cube 102 has a central through bore 104 having a transverse dimension slightly smaller than the second outer diameter of each of the end members 36, 38 of the connection stems 22 and slightly larger than the first outer diameter of the central member 34 of the connection stems.

Figure 12D:
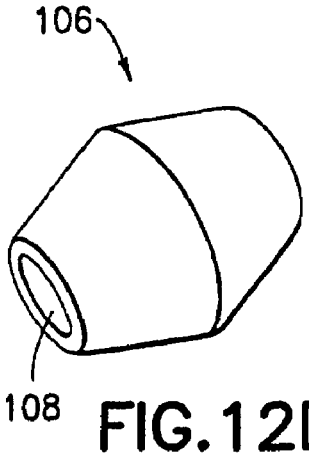

In FIG. 12D, a three dimensional trapezoidal component 106 has a central through bore 108 having a transverse dimension slightly smaller than the second outer diameter of each of the end members 36, 38 of the connection stems 22 and slightly larger than the first outer diameter of the central member 34 of the connection stems.

Figure 12E:
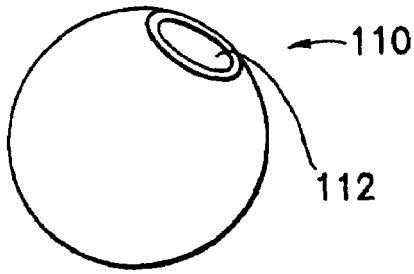

In FIG. 12E, a simple sphere 110 has a central through bore 112 having a transverse dimension slightly smaller than the second outer diameter of each of the end members 36, 38 of the connection stems 22 and slightly larger than the first outer diameter of the central member 34 of the connection stems.

Figure 12F:
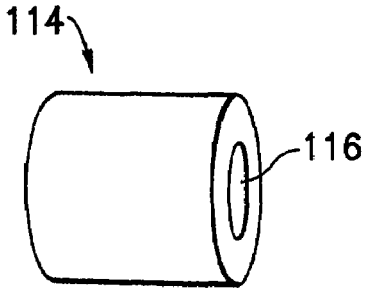

In FIG. 12F, a simple cylinder 114 has a central through bore 116 having a transverse dimension slightly smaller than the second outer diameter of each of the end members 36, 38 of the connection stems 22 and slightly larger than the first outer diameter of the central member 34 of the connection stems.

Figure 12G:
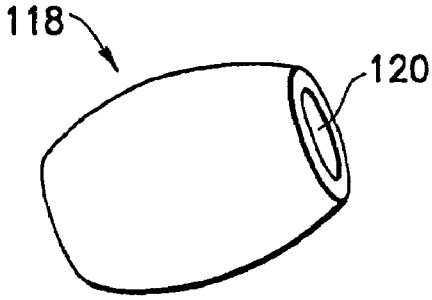

In FIG. 12G, an ovoid component 118 has a central through bore 120 having a transverse dimension slightly smaller than the second outer diameter of each of the end members 36, 38 of the connection stems 22 and slightly larger than the first outer diameter of the central member 34 of the connection stems.

Each of the components illustrated in FIGS. 11 and 12A through 12G can be attached to the assembly 20 in any manner and configuration desired by an operator.

Figure 13:
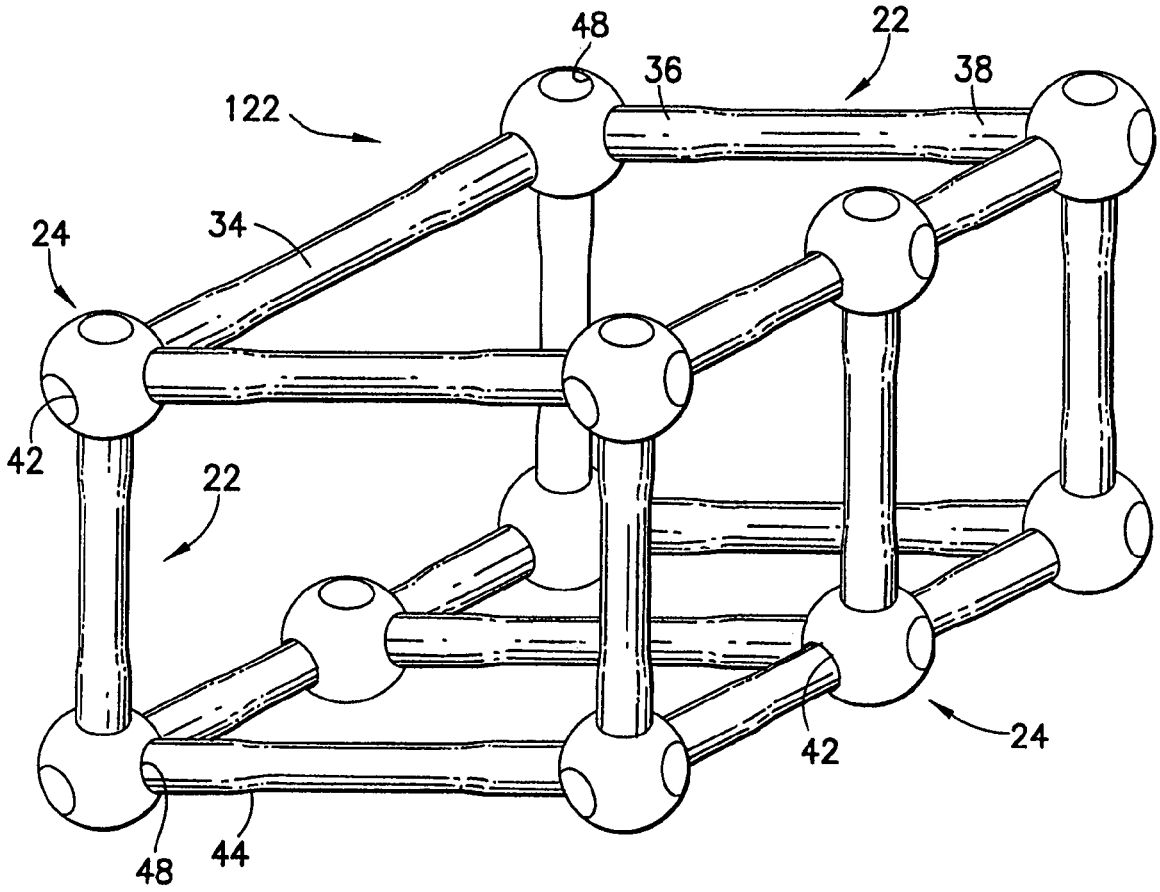
FIG. 13 is a perspective view of a stationary assembly of the invention using only the primary components of the invention.

FIG. 13 is provided merely to illustrate a stationary assembly using only the primary components of connection stems 22 and attachment members 24.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A construction system comprising:

an elongated connection stem extending between free tip ends and having an outer peripheral surface and a longitudinal axis and including:

a central member having a uniform first dimension transverse of the longitudinal axis;

opposed end members integral with the central member, each having a uniform second dimension transverse of the longitudinal axis greater than the first transverse dimension, each opposed end member having a longitudinal slot formed into the outer peripheral surface extending from its associated free tip end toward the central member; and an attachment member having a central through bore slightly smaller than the second transverse dimension of each of the end members;

a cross section of each of the end members perpendicular to the longitudinal axis being of similar shape to that of the central through bore and being slightly larger in size than the central through bore; and a cross section of the central member perpendicular to the longitudinal axis being of similar shape to that of the central through bore but of smaller size than the central through bore;

whereby, in one instance, the attachment member can be fittingly received, via the central through bore, on either of the opposed end members and, in another instance, the attachment member can be slidably received, via the central through bore, on the central member.

2. A construction system as set forth in claim 1 wherein the connection stem is substantially cylindrical;

wherein the central member has a first outer diameter;

wherein each of the opposed end members has a second outer diameter; and wherein the attachment member has a substantially cylindrical through bore having a diameter slightly smaller than the second outer diameter of each of the end members and slightly larger than the first outer diameter of the central member.

3. A construction system as set forth in claim 1 wherein the length of the attachment member in a direction parallel with the through bore is less than the length of the central member between the opposed end members.

4. A construction system as set forth in claim 1 wherein the attachment member has a generally spherical outer peripheral surface.

5. A construction system as set forth in claim 1 wherein the attachment member has a generally cylindrical outer peripheral surface.

6. A construction system as set forth in claim 1 wherein the attachment member has at least one partial bore aligned with an axis transverse that of the central through bore; and wherein a cross section of each of the end members perpendicular to the longitudinal axis is of similar shape to that of the partial bore and slightly larger than the diameter of the partial bore; and whereby the attachment member can be fittingly received via the partial bore on either of the opposed end members.

7. A construction system as set forth in claim 6 wherein the connection stem is substantially cylindrical;

wherein the central member has a first outer diameter;

wherein each of the opposed end members has a second outer diameter;

whereby the attachment member has a substantially cylindrical through bore having a diameter slightly smaller than the second outer diameter of each of the end members and slightly larger than the first outer diameter of the central member and at least one cylindrical partial bore having a diameter slightly smaller than the second diameter of each of the end members.

8. A construction system as set forth in claim 6 wherein the length of the attachment member in a direction parallel with the through bore is less than the length of the central member between the opposed end members.

9. A construction system as set forth in claim 6 wherein the attachment member has a generally spherical outer peripheral surface.

10. A construction system as set forth in claim 6 wherein the attachment member has a generally cylindrical outer peripheral surface.

11. A construction system as set forth in claim 1 wherein the central member of the connection stem is curved.

12. A construction system as set forth in claim 1 wherein the outer peripheral surface of the connection stem has a smoothly contoured transition zone between each of the end members and the central member.

13. A construction system as set forth in claim 1 including at least one rolling member for movement along a supporting surface, said rolling member including:

an axle having an outer peripheral surface and a longitudinal axis including:

a cylindrical central member having a uniform first outer diameter;

a free end member integral with and axially aligned with the central member having a uniform second outer diameter greater than the first outer diameter and a longitudinal slot formed into the outer peripheral surface extending from its associated free tip end toward the central member; and a stop member integral with the central member and spaced from the free end member and having a transverse dimension substantially greater than the central member and the free end member; and a wheel including:

a central hub having a journal bore with an inner diameter slightly larger than the first outer diameter of the central member of the axle; and a circular outer rim;

wherein the central hub of the wheel is slidably received on the central member of the axle, the rolling member is so assembled mounted by engagement of each free end member with a partial bore of an attachment member and the outer rim of the wheel is rollingly engaged with the supporting surface.

14. A construction system as set forth in claim 13 including at least one spoke member joining the outer rim to the central hub.

15. A construction system as set forth in claim 13 for forming an assembly that includes a plurality of elongated connection stems and a plurality of attachment members.

16. A construction system as set forth in claim 1 wherein the opposed end members of the connection stem each have a smoothly contoured transition zone and each have a substantially cylindrical shape with substantially the same diameter from the transition zone to the associated free tip end.

17. A construction system as set forth in claim 1 wherein said central member is of solid construction.

18. An assembly utilizing a construction system comprising:

a plurality of elongated connection stems, each connection stem extending between free tip ends and having an outer peripheral surface and a longitudinal surface, each connection stem including:

a central member having a uniform first dimension transverse of the longitudinal axis;

opposed end members integral wit the central member, each having a uniform second dimension transverse of the longitudinal axis greater than the first transverse dimension, each opposed end member having a longitudinal slot formed into the outer peripheral surface extending from its associated free tip end toward the central member; and a plurality of attachment members, each attachment member having a central through bore slightly smaller than the second transverse dimension of each of the end members and a plurality of partial bores, each partial bore being aligned with an axis transverse that of the central through bore and having a transverse dimension slightly smaller than the second transverse dimension of each of the end members;

a cross section of each of the end members perpendicular to the longitudinal axis being of similar shape and slightly larger in size than the central through bore and than the partial bore; and a cross section of the central member perpendicular to the longitudinal axis being of similar shape to that of the central through bore but of smaller size than the central through bore;

some of the attachment members being fittingly received, via the through bore, on the opposed end members of some of the connection stems;

some of the attachment members being received, via the through bore, in each of the attachment members, on the central members of some of the connection stems; and some of the free tip ends of the end members of the connection stems being fittingly received in the partial radial bores of the attachment members such that each such connection stem extends away from the attachment member in a direction transverse that of the axis of another connection stem connected to the attachment member;

all resulting in a completed assembly.

19. An assembly as set forth in claim 18 wherein each connection stem is substantially cylindrical;

wherein each central member has a first outer diameter;

wherein each of the opposed end members has a second outer diameter;

whereby each attachment member has a substantially cylindrical through bore having a diameter slightly smaller than the second outer diameter of each of the end members and slightly larger than the first outer diameter of the central member and a plurality of cylindrical partial bores having a diameter slightly smaller than the second diameter of each of the end members.

20. An assembly as set forth in claim 18 wherein the length of each attachment member in a direction parallel with the through bore is less than the length of each central member between the opposed end members.

21. An assembly as set forth in claim 18 wherein each attachment member has a generally spherical outer peripheral surface.

22. An assembly as set forth in claim 18 wherein each attachment member has a generally cylindrical outer peripheral surface.

23. An assembly as set forth in claim 18 wherein the central member of the connection stem is curved.

24. An assembly as set forth in claim 18 including:

a plurality of decorative components of various configurations, each decorative component including a body with a central through bore having a transverse dimension slightly smaller than the second outer diameter of each of the end members and slightly larger than the first outer diameter of the central member.

25. An assembly utilizing a construction system comprising:

a plurality of elongated connection stems, each connection stem extending between free tip ends and having an outer peripheral surface and a longitudinal surface, each connection stem including:

a central member having a uniform first dimension transverse of the longitudinal axis;

opposed end members integral with the central member, each having a uniform second dimension transverse of the longitudinal axis greater than the first transverse dimension, each opposed end member having a longitudinal slot formed into the outer peripheral surface extending from its associated free tip end toward the central member; and a plurality of attachment members, each attachment member having a central through bore slightly smaller than the second transverse dimension of each of the end members and a plurality of partial bores, each partial bore being aligned with an axis transverse that of the central through bore and having a transverse dimension slightly smaller than the second transverse dimension of each of the end members;

a cross section of each of the end members perpendicular to the longitudinal axis being of similar shape and slightly larger in size than the central through bore and than the partial bore; and a cross section of the central member perpendicular to the longitudinal axis being of similar shape to that of the central through bore but of smaller size than the central through bore;

some of the attachment members being fittingly received, via the through bore, on the opposed end members of some of the connection stems;

some of the attachment members being received, via the through bore, in each of the attachment members, on the central members of some of the connection stems; and some of the free tip ends of the end members of the connection stems being fittingly received in the partial radial bores of the attachment members such that each such connection stem extends away from the attachment member in a direction transverse that of the axis of another connection stem connected to the attachment member;

all resulting in a completed assembly including a plurality of rolling members supporting the assembly for movement along a supporting surface, each rolling member including:

an axle having an outer peripheral surface and a longitudinal axis including:

a cylindrical central member having a uniform first outer diameter;

a free end member integral with and axially aligned with the central member having a uniform second outer diameter greater than the first outer diameter and a longitudinal slot formed into the outer peripheral surface extending from its associated free tip end toward the central member; and a stop member integral with the central member and spaced from the free end member and having a transverse dimension substantially greater than the central member and the free end member; and a wheel including:

a central hub having a journal bore with an inner diameter slightly larger than the first outer diameter of the central member of the axle;

a circular outer rim; and spoke members joining the outer rim to the central hub;

whereby, with the central hub of the wheel slidably received on the central member of the axle and with a plurality of the rolling members so assembled mounted on the assembly by engagement of each free end member with a partial bore of an attachment member and with the outer rims of the wheels rollingly engaged with the supporting surface, the assembly is selectively movable along the supporting surface.

* * * * *